US005365954A

United States Patent [19]

Rude

[11] Patent Number: 5,365,954

[45] Date of Patent: Nov. 22, 1994

[54] HAIR DRESSING TOOL

[76] Inventor: Shirley M. Rude, 616 E. 28th St., Sioux Falls, S. Dak. 57105

[21] Appl. No.: 209,733

[22] Filed: Mar. 14, 1994

[51] Int. Cl.[5] ..... A45D 8/12

[52] U.S. Cl. ..... 132/275; 132/273

[58] Field of Search ..... 132/212, 273, 275, 276, 132/280, 281

[56] References Cited

U.S. PATENT DOCUMENTS

| | | | |
|---|---|---|---|
| 299,879 | 6/1884 | Tisdale | 132/275 |
| 565,884 | 8/1896 | Emmons | 132/275 |
| 569,144 | 10/1896 | Whiteley | 132/275 |
| 2,960,091 | 11/1960 | Van Dusen et al. | 132/280 |
| 3,842,849 | 10/1974 | Goodman | 132/273 |
| 5,251,650 | 10/1993 | Edmark | 132/275 |

*Primary Examiner*—Gene Mancene
*Assistant Examiner*—Frank A. LaViola

[57] ABSTRACT

An ornamental device for placement in long hair arrangements. The device is designed with a pin to prevent slippage of the device on the hair.

3 Claims, 1 Drawing Sheet

HAIR DRESSING TOOL

BACKGROUND AND SUMMARY OF THE INVENTION

This invention pertains to devices to hold long hair arrangements and to the ornamentation of such devices.

Many people prefer to let their hair grow long. This has been particularly true of young women, but it is now also true of men. In the past, many such people brought their hair into a single, or occasionally, a double strand and then rolled the strand into a "bun" which has then held close to the head by hair pins.

Other patterns of hairdo for long hair included braiding the hair into one or more "pigtails", sometimes using an ornamental device at the end of such pigtail. Another pattern was simply gathering the hair into one or more strands or "ponytail" in which case an ornamental device-often a ribbon and sometimes a metal or plastic ring-placed close to the wearer's head was used to hold the bundle of hair in a single strand.

The present invention pertains to the ponytail hairdo although it may be easily adapted to a braided pigtail as well. In both types of hairdo, one problem has been the tendency of clamping ornaments to slide down on the collected bundle of hair. This invention comprises the provision of an auxiliary device on the ornamental clasp adapted to be inserted into the bundle of hair to hold the clasp in place, and to avoid slippage of the device on the hair.

DESCRIPTION

Briefly this invention comprises the provision of a hair clasp for use on braided or "ponytail" or similar hair arrangements.

Figure 6:
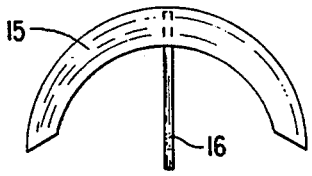
FIG. 6 is a top view of the clasp of FIG. 3.
Figure 3:
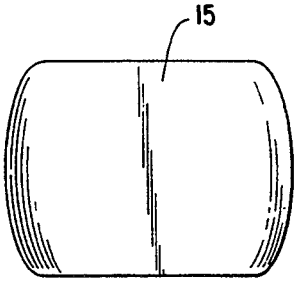
FIG. 3 is a rear elevational view of the clasp apart from the hair.
Figure 4:
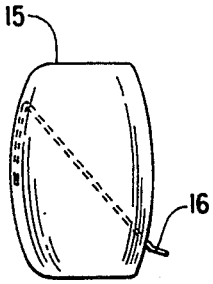
FIG. 4 is a side elevational view of the clasp of FIG. 3.
Figure 5:
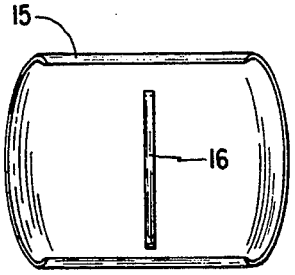
FIG. 5 is a front elevational view of the clasp of FIG. 3.
Figure 1:
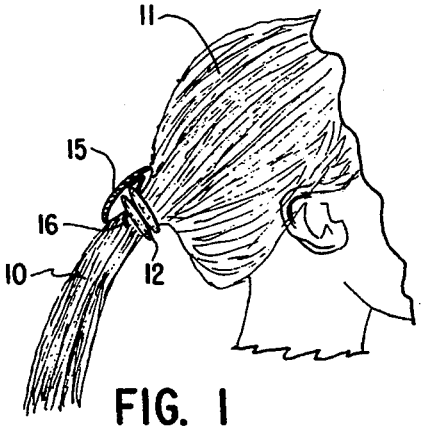
FIG. 1 is a side elevational view of the clasp in place on a "ponytail", with the clasp shown in section to show the underlying part.
Figure 2:
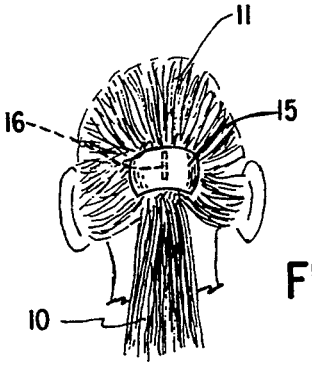
FIG. 2 is a back view of the device of FIG. 1.

More specifically and referring to the figures, the device is illustrated for use on a ponytail arrangement such as shown at 10 in FIGS. 1 and 2. These arrangements are made simply by collecting strands of hair from one's head 11, arranging them so that they lie in substantially the same direction, and then confining them within an elastic band 12. This band may be formed by using multiple loops of an ordinary rubber band, or may be of any other similar facility.

The ornamental metal or plastic clasp of the invention is better shown in FIGS. 3–7. In general, it comprises an ornamental plate 15 which is curved somewhat in the pattern of the ponytail, although the curvature is not absolutely necessary. The surface of the plate may have ornaments embossed on it, or may be jewel studded with either real or imitation gems, or be enamelled or molder plastic or otherwise decorated. Such ornamentation may be desirable for cosmetic purposes but has no effect on the function of the device.

To hold the clasp to the hair, I provide a prong 16 fixed to an inner surface of the clasp. This prong is fastened near one edge of the clamp and extends outwardly and toward the opposite edge of the clasp. It is narrow, and may be pointed for easy insertion into the hairdo between the strands of hair.

In use, then, the ponytail is formed and enclosed by the band 12. The clasp is then placed with the prong 16 extending among the strands of the ponytail towards the loose ends of the hair and within the loop formed by the elastic band 12.

Figure 7:
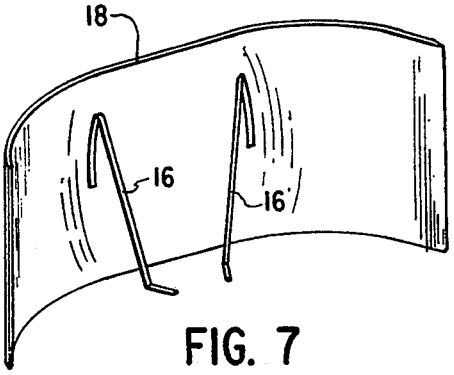
FIG. 7 is a perspective view of an alternate clasp.

It will be apparent that many variation of the clasp are possible. One is shown in FIG. 7 where a clasp 18 of different shape is shown. Because this one is somewhat flatter than that first shown, it may be desirable to provide a plurality of prongs 16. A flat bar or barrette may also be used.

It will also be evident that other types of clasps may be used. It is common for these clasps to have some type of closure to surround the ponytail. If desired, that type of closure is very adaptable to the clasp of this invention. Other variations will surely be evident.

I claim as my invention:

1. An ornamental clasp for use with hair arrangements having hair strands gathered together in a tail form, said ornamental clasp comprising:

an ornamented plate having edges;

prong means fixed to said ornamented plate at a fixed point on an inner surface near one edge thereof, said prong means extending away from the fixed point in a direction away from said one edge and across said ornamented plate to an end point positioned below said fixed point and spaced away from said ornamented plate, whereby said prong means is adapted to engage said tail form diagonally across said tail form.

2. The ornamental clasp of claim 1 in which said hair arrangement, emanating from a source, is held together by an elastic band, said prong means being engageable within said hair arrangement at said elastic band between the source of the hair and the band.

3. The ornamental clasp of claim 1 in which said prong means includes at least one prong of narrow and thin material adapted to be easily insertable into said hair arrangement.

* * * * *